US007744383B2

(12) United States Patent
Da Silva

(10) Patent No.: US 7,744,383 B2
(45) Date of Patent: Jun. 29, 2010

(54) GROUNDED CONNECTOR

(75) Inventor: Mark Da Silva, Hook (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 139 days.

(21) Appl. No.: 12/286,431

(22) Filed: Sep. 30, 2008

(65) Prior Publication Data

US 2009/0104801 A1 Apr. 23, 2009

(30) Foreign Application Priority Data

Oct. 19, 2007 (GB) ..... 0720537.0

(51) Int. Cl.
*H01R 4/66* (2006.01)

(52) U.S. Cl. ..... 439/92; 439/101

(58) Field of Classification Search ..... 439/607.01, 439/607.04, 607.17, 101, 108, 680, 92, 95, 439/98

See application file for complete search history.

(56) References Cited

U.S. PATENT DOCUMENTS 4,140,367 A * 2/1979 Makuch et al. ..... 385/59
4,229,064 A * 10/1980 Vetter et al. ..... 439/680
5,637,010 A * 6/1997 Jost et al. ..... 439/352
6,796,812 B2 * 9/2004 Reicharz ..... 439/108
7,154,042 B2 * 12/2006 Auray et al. ..... 174/70 R

* cited by examiner

*Primary Examiner*—Thanh-Tam T Le
(74) *Attorney, Agent, or Firm*—Peter Van Winkle

(57) ABSTRACT

Ground connections are made between first and second electrical connectors (1, 27). The first connector has a first sleeve (5) and has contact elements (23) mounted on the first sleeve. The second connector has a second sleeve (31) with slots (35) that receive the contact elements (23) when the connectors mate. Locating ribs (21) lie forward (F1) of the contact elements to align the slots in the second sleeve with the contact elements.

10 Claims, 3 Drawing Sheets

GROUNDED CONNECTOR

CROSS-REFERENCE

Applicant claims priority from Great Britain patent application GB 0720537.0 filed 19 Oct. 2007.

BACKGROUND OF THE INVENTION

This invention relates to electrical connectors having a means for providing an electrical grounding connection. More particularly, though not exclusively, this invention relates to shielded electrical connectors.

Electrical connectors having a means for providing an electrical grounding connection are well known. These connectors are often used for mechanically and electrically coupling shielded cables, which are electrical cables in which one or more insulated inner conductor is enclosed by a conductive shielding layer. Where there is a single insulated inner conductor, shielded cables are sometimes called coaxial cables.

Shielded cables are used in applications where it is desired to minimized the effect of electrical noise on signals which are being carried in the cables or to reduce the electromagnetic radiation emitted by the cables. The former is particularly important for cables carrying high bandwidth signals which are particularly susceptible to noise. The latter is important for cables carrying high voltages.

In a shielded cable, the shielding is usually in the form of plated braided strands of copper which surround the inner conductor(s), although other conductive shielding arrangements such as spiral windings of metallic foil and sleeves of conductive polymers are also known. The shielding is usually grounded, although the shielding may in some applications carry signals. In either case, it is important that the electrical connector maintains the shielding and provide a reliable electrical connection for both the inner conductor(s) and the shielding/grounding.

In a known shielded electrical connector, the shielding/grounding connection is provided by a rigid conductive sleeve arranged around a dielectric spacing member, which spacing member accommodates at least one elongate contact terminal for connecting the inner conductors. The metallic sleeve functions to provide the mechanical coupling of the connector, and the electrical coupling of the shielding/grounding, to a cable at one end and a mating connector at the other end.

In the known shielded electrical connector, the mechanical coupling means often includes circumferential "keys" which have to be aligned with circumferential recesses or cut outs provided in the conductive sleeve of a mating connector. The electrical coupling means usually comprises a resilient metallic band arranged around the conductive sleeve of the connector. The resilient band has an interference fit with the sleeve of the mating connector, so as to ensure reliable electrical contact. That is to say, the resilient band holds itself in position by being diametrically smaller than the sleeve so that the band exerts a positive compressive spring force.

A problem associated with the known connector described above is that the resilient metallic band used for electrically connecting the shielding consumes space in the axial direction of the connector. For example, in a typical known connector, the width of the resilient metallic band can be as much as 6 mm.

SUMMARY OF THE INVENTION

According to an aspect of the invention, there is provided an electrical connector comprising a conductive sleeve for providing an electrical grounding connection, the sleeve having at least one discrete radial protrusion provided around the circumference of the sleeve, wherein at least one side surface of the protrusion is provided with a resilient conductive electrical connecting means arranged such that, when the protrusion is mated with a corresponding recess in a sleeve of a mating connector, the connecting means is deformed and thereby bears on the sleeves of both connectors.

The invention thus provides for connectors in which the sleeves of the connectors, which provide the electrical grounding connection, are electrically connected by connecting elements which bear on the side surfaces of discrete circumferential protrusions (of the electrical connector) and recesses (of the mating connector) in substantially circumferential directions.

Such a connecting arrangement for the connector sleeves can be integrated into, or combined with, the keying arrangement used for the circumferential alignment of the connectors with respect to each other. The mechanical effort required for coupling such connectors may also be more progressive.

In a preferred embodiment, the connector further comprises at least one elongate conductive inner terminal arranged within the sleeve and separated therefrom by a dielectric spacing member. These inner terminals are provided for connecting the inner conductors of cables.

The inner and/or outer surfaces of the sleeve of the connector may be substantially cylindrical and may have a circular cross section, in which case the sleeve defines an axis of the connector. The protrusion may be provided on the inner surface or on the outer surface of the sleeve.

It is particularly preferred that there are a plurality of the discrete radial protrusions equally or non-equally spaced around the circumference of the sleeve. In this case, there may be a corresponding plurality of the connecting means each associated with a respective one of the protrusions.

The protrusion may comprise an axially extending rib, and the connecting means may then comprise an elongate metallic element arranged around a first (forward) end of the axial rib. Such a metallic element may be a strip of metal or a length of metal wire pre-formed for fitting around the first end of the axial rib. The ends of this metallic element are preferably incurvately arranged for bearing on the opposing side surfaces of the axial rib.

The protrusion may also define a flange at a second (rearward) end of the axial rib for restricting axial and rotational movement of the metallic element. Alternatively, the protrusion may define a recess at the second end of the axial rib for receiving the ends of the metallic element more securely.

The metallic element may be biased inwards towards the side surfaces of the axially extending rib. The metallic element may also be arranged for an interference fit with the recess in the sleeve of the mating connector.

The sleeve of the connector may also have a second discrete radial protrusion arranged axially in front of the axial rib for circumferentially locating the connectors with respect to each other. The circumferential dimension of the second protrusion may be greater than the corresponding dimension of the axially extending rib and less than the corresponding dimension of the metallic element. The second protrusion may be arranged for a clearance fit with the recess in the sleeve of the mating connector.

The connector may further comprise a second sleeve arranged coaxially with the conductive sleeve, for example an outer sleeve. The connecting means may be captively arranged between the conductive sleeve and the second sleeve. The second sleeve may also be rotatable relative to the first sleeve and be provided with a thread or some other means for axially locking the connectors together.

The connector may be for the transmission of data signals, in which case there may be a single inner terminal for a single inner conductor or alternatively a plurality of inner terminals for a plurality of inner conductors. The connector may alternatively be for the transmission of high voltages, for example voltages in excess of 2000 volts. The inner terminals may be capable of carrying, or rated for, currents of at least 3 Amps.

The connector may be adapted at one end for coupling to the mating connector. The other end of the connector may be adapted for connection to a cable, or may alternatively terminate in connecting pins, for example for connection to a printed circuit board.

The connector may be a shielded electrical connector, in which case the sleeve is arranged for providing electrical shielding.

According to another aspect of the invention, there is provided an electrical connector comprising a conductive sleeve for providing an electrical grounding connection, the sleeve having at least one discrete radial recess provided around the circumference of the sleeve, wherein at least one side surface of the recess is provided with a resilient conductive connecting means arranged such that, when the recess is mated with a corresponding protrusion in a sleeve of a mating connector, the connecting means is deformed and thereby bears on the sleeves of both connectors.

This aspect of the invention is similar to the aspect described previously, except that the connecting means is provided at the side surface of a recess of the connector, which recess is for mating with corresponding protrusion of a mating connector. The recess may be formed in the inner or outer surface of the sleeve, or may be formed all the way through the sleeve, in which case the recess is a cut out.

The preferred and optional features of the first aspect of the invention described previously are equally applicable to this aspect of the invention, except that references to the protrusion relate instead to the recess.

The invention also provides an electrical connection arrangement comprising: a first connector, wherein the first connector is the electrical connector described above; and a second connector, wherein the second connector is the mating connector described above, wherein the protrusion or recess and the connecting means of the first connector are for mating with the corresponding recess or protrusion, respectively, in the sleeve of the second connector, such that the connecting means is deformed and thereby bears on the sleeves of both connectors.

The novel features of the invention are set forth with particularity in the appended claims. The invention will be best understood from the following description when read in conjunction with the accompanying drawings.

DESCRIPTION OF THE DRAWINGS

A specific embodiment of the invention will now be described, by way of example only, with reference to the accompanying drawings, in which.

DESCRIPTION OF THE INVENTION

1. Limited Description

Figure 7:
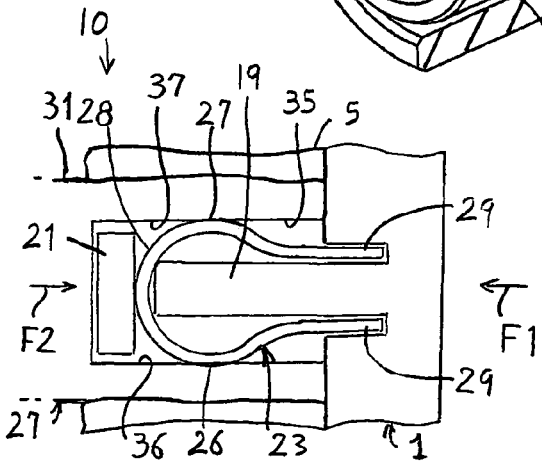
FIG. 7 is a side elevation view of a portion of the connector of FIG. 2.
Figure 3:
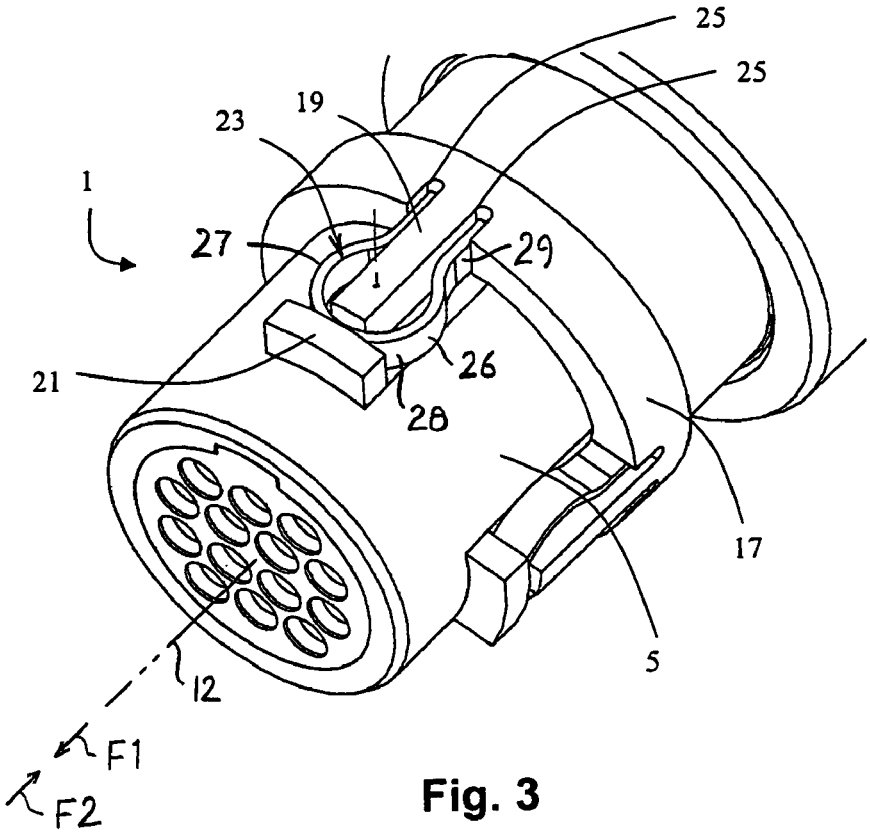
FIG. 3 is a more detailed perspective view of the connector shown in FIG. 1, with part of the structure removed.
Figure 5:
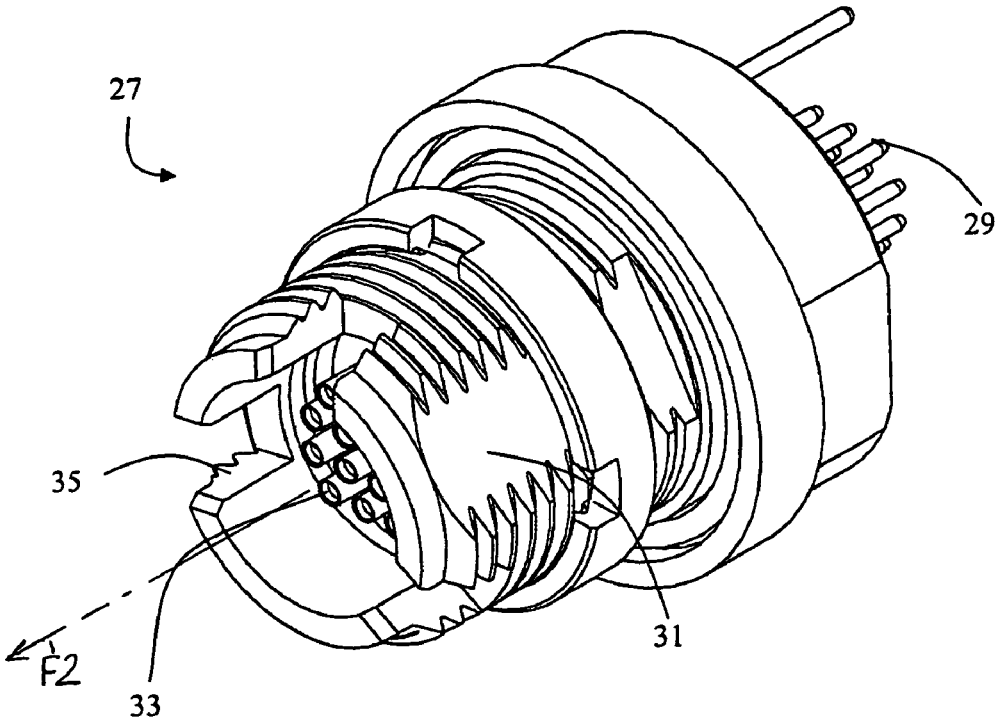
FIG. 5 is a perspective view of a mating connector for connection to the connector shown in FIG. 1.

FIG. 3 illustrates a first electrical connector 1 but showing it without an outer sleeve. The figure shows that the first connector has an inner, or first electrically conductive sleeve 5 and a plurality of resilient ground, or shield, contact member 23 mounted on the first sleeve. The first connector can move in a first forward direction F1 along a mating axis 12 to mate with a second connector. FIG. 5 shows the second connector 27, which has a second electrically conductive sleeve 31 with cutouts, or radial sleeve slots 35. The second sleeve receives the first connector sleeve when the second connector moves in a second forward direction F2 along the mating axis. FIG. 7 shows an electrical connector assembly 10 that includes the first and second connectors 1, 27, with the connectors having moved in the mating directions F1, F2 and being fully mated. One of the contact members 23 that is mounted on the first sleeve 5, lies in a slot 35 of the second sleeve 31. The contact member 23 has a front engaging part 28 with opposite contacting sides 26, 27 that engage opposite sides 36, 37 of the second sleeve slot 35.

Figure 4:
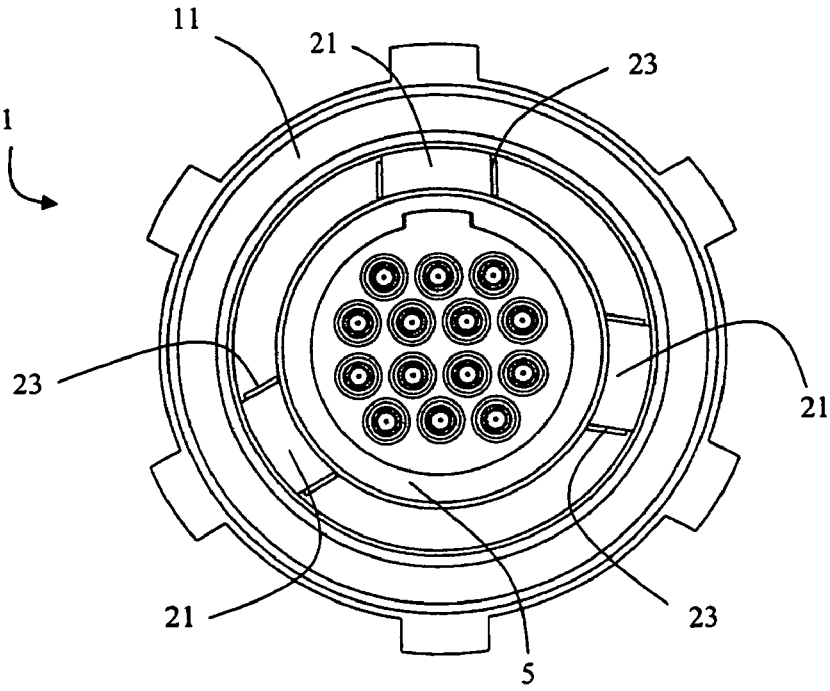
FIG. 4 is an axial front view of the connector shown in FIG. 1.

FIG. 3 shows that the front part 28 of the contact member 23 extends more than 180° around a radially-extending axis. The contact member has a pair of parallel legs 29 that lie in axially-extending slots 25 of a flange 17 of the sleeve 5. The slots 25 lie on circumferentially opposite sides of an axial rib 19 of the first sleeve, which closely locates the contact member. The front end of the rib 19 lies adjacent to the front end of the connecting element. A connector locating rib 21 lies forward of the contact member. FIG. 4 shows that the locating rib 21 has a circumferential width that is slightly less than the width of the front engaging part of the contact member 23. As a result, when the slots 35 (FIG. 5) in the second sleeve are properly aligned with the axial ribs 21 the opposite slot walls are in line with opposite sides of a corresponding contact element. When the connectors are then moved together, the slots receive the front portions of the contact members and the shielding conductors of the two connectors are reliably connected.

2. Detailed Description

The invention provides an electrical connector comprising a conductive sleeve for providing an electrical grounding connection. The sleeve has at least one discrete radial protrusion provided around the circumference of the sleeve. At least one side surface of the protrusion is provided with a resilient conductive connecting means, such as a curved metallic element. The connecting means is arranged such that, when the protrusion is mated with a corresponding recess in a sleeve of a mating connector, the connecting means is deformed and thereby bears on the sleeves of both connectors. In this way, a reliable electrical connection may be formed between the sleeves of connectors. This connecting functionality may be incorporated within the length of the keying arrangement used for circumferentially aligning the connectors with respect to each other, thereby allowing for miniaturization.

Figure 1:
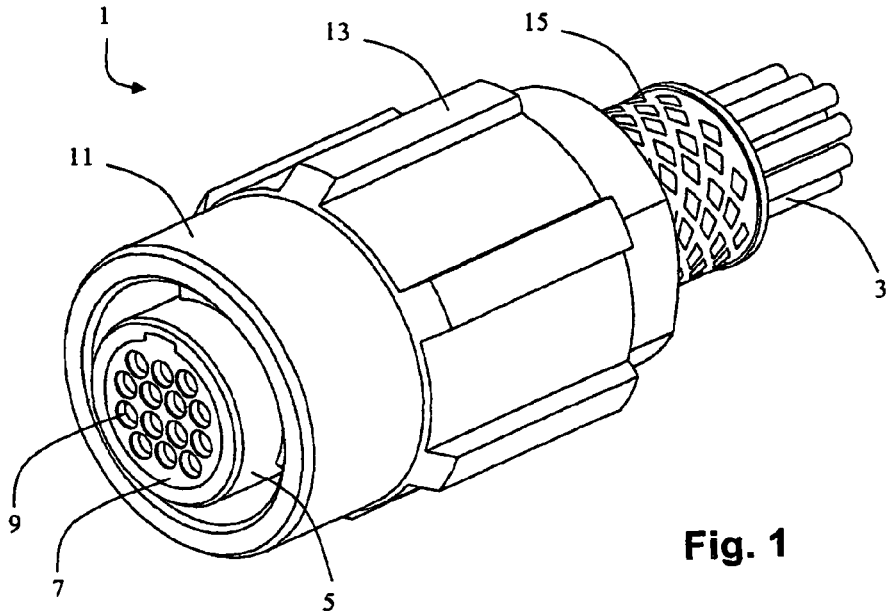
FIG. 1 is a perspective view of a shielded electrical connector according to the invention.

FIG. 1 is a perspective view of a shielded electrical connector 1 which embodies the invention. Also shown in the Figure are the inner conductors 3 of a shielded cable, but these are included only for the sake of clarity and do not form part of the connector 1.

The connector 1 comprises an inner sleeve 5 which defines an axis of the connector 1. The inner sleeve 5 is formed of a conductive metallic material such as stainless steel or aluminum and provides the electrical shielding for the connector 1. The inner sleeve 5 has a substantially cylindrical shape with a substantially circular cross section.

Mounted within the inner sleeve 5 is a cylindrical dielectric member 7 formed of a dielectric material such as a plastics material. The dielectric member 7 is formed with a plurality of elongate holes 9 each having an axis parallel to the connector axis. A plurality of elongate inner terminals (not shown) are provided within the holes 9 of the dielectric member 7. The inner terminals are formed of a conductive metallic material such as an alloy of copper and may be provided with an outer layer of another conductive metallic material such as gold or platinum. The inner terminals are spaced from one another and from the inner sleeve 5 by the dielectric member 7. The inner terminals function to connect the inner conductors 3 of a cable to the cable of a mating connector. Suitable arrangements for the inner terminals are conventional and are not therefore explained herein in detail.

The connector 1 also comprises an outer sleeve 11 arranged to be coaxial with and to substantially surround the inner sleeve 5. The outer sleeve 11 is arranged to be rotatable about the inner sleeve 5, but its axial movement relative to the inner sleeve 5 is restricted by an inner circumferential flange (see FIG. 2) which is confined between an outer circumferential flange of the inner sleeve 5 and the forward edge of a back fitting 15 (described below). The inner surface of the outer sleeve 11 is provided at its forward end with a screw thread (not shown) for mechanically coupling the connector 1 with a mating connector. The outer surface of the outer sleeve 11 is provided along a part of its length with axial ribs 13 for hand tightening the screw thread.

Also shown in FIG. 1 is a back fitting 15 of the connector 1. The back fitting 15 functions to terminate a cable to the connector 1 and is in the form of another sleeve which is received between the inner and outer sleeves 5, 11 at a rearward end of the connector 1. Suitable arrangements for the back fitting 15 are conventional and will not be described herein in detail.

Figure 2:
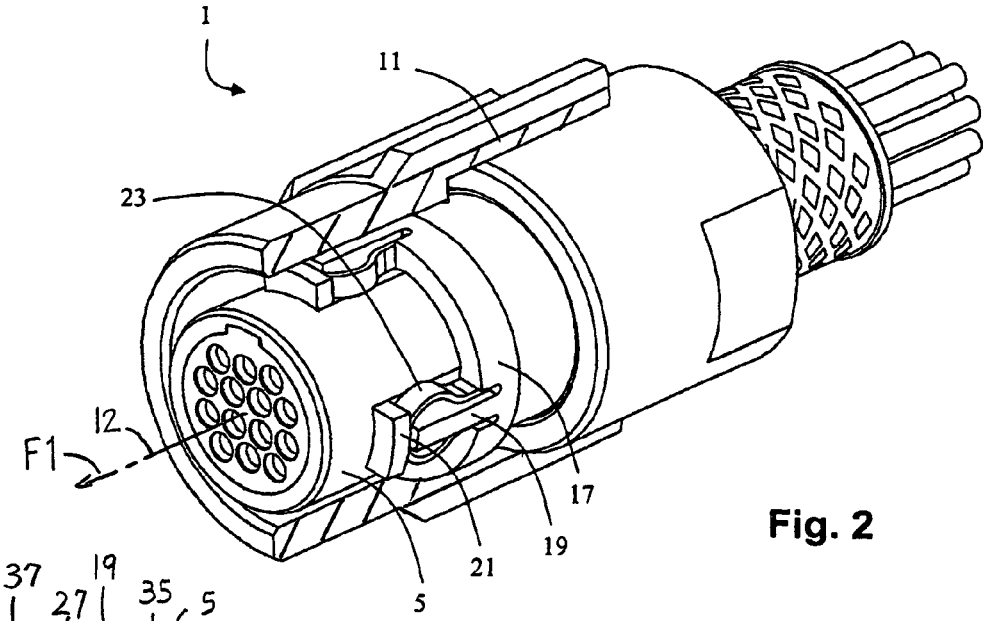
FIG. 2 is a perspective view of the connector shown in FIG. 1, with part of the structure cut away.

FIG. 2 is a perspective view of the connector 1 shown in FIG. 1, with a part of the outer sleeve 11 cut away to show the underlying structure of the connector 1. FIG. 3 is another perspective view of the connector 1 shown in Figure, but with the outer sleeve 11 omitted completely.

With reference to FIGS. 2 and 3, it can be seen that the inner sleeve 5 of the connector 1 is formed with an outer circumferential flange 17. Axially extending ribs 19 extend forwards from the circumferential flange 17 at three discrete positions spaced about the circumference of the inner sleeve 5. The outer surface of the inner sleeve 5 is also provided with three circumferentially extending ribs 21 arranged directly in front of and spaced from the axially extending ribs 19. Each pair of ribs 19, 21 define an approximate "T" shape.

The circumferentially extending ribs 21 function to circumferentially locate the connector 1 with respect to a mating connector. That is to say, the circumferentially extending ribs 21 provide a keying function. In particular, the circumferentially extending ribs 21 of the inner sleeve 5 are received into corresponding circumferential cut outs in a sleeve of the mating connector. The circumferentially extending ribs 21 are arranged to be received into the cut outs in the mating connector with a clearance fit.

FIG. 4 is an axial view of the connector shown in FIGS. 1, 2 and 3. It can be seen from FIG. 4 that the three circumferentially extending ribs 21 are non-equally spaced around the circumference of the inner sleeve 5. Consequently, the circumferentially extending ribs 21 may only be received into the corresponding cut outs in the mating connector in one particular angular relationship, to thereby ensure that the inner terminals of the connectors are correctly coupled.

While the inner sleeve 5 of the connector 1 provides the electrical shielding for the inner terminals, it is often desirable for the shielding to be grounded. In other cases, it can be desirable for the shielding of the connector 1 to be connected to some other electrical potential or even carry a time-varying signal.

Thus, the connector 1 needs a mechanism whereby a reliable electrical connection is made between the inner sleeve 5 of the connector and the sleeve of a mating connector. The clearance fit between the circumferentially extending ribs 21 of the inner sleeve 5 of the connector and the cut outs of the mating connector do not generally provide a sufficiently reliable electrical connection.

Accordingly, the connector further comprises a connecting means in the form a resilient metallic connecting element 23 arranged around each of the axially extending ribs 19 of the inner sleeve 5 of the connector 1. Three such connecting elements 23 are provided in the connector 1. The connecting elements 23 are formed from thin strips of a metal such as stainless steel or copper, and may be provided with an outer layer of another conductive metallic material such as gold or platinum.

The connecting elements 23 are curved around the forward ends of the axially extending ribs 19. A portion of the connecting elements 23 passes between the axially extending ribs 19 and the circumferentially extending ribs 21 to define the major part of a circle with an outer diameter significantly greater than a width of the axially extending ribs 19 and slightly greater than a length of the circumferentially extending ribs 21. As such, the outer margins of the connecting elements 23 can be seen protruding beyond the circumferentially extending ribs 21 in the in FIG. 4.

The ends of the connecting elements 23 have incurvate form in the sense that they are curved inwardly, towards each other, before becoming parallel with the sides of the axially extending ribs 19. At the second end of the axially extending ribs 19, the ends of the connecting elements 23 are received in the recesses 25 formed in the circumferential flange 17 on either side of the ribs 19.

The connecting elements 23 are biased so that, in the neutral position, their ends bear against the sides of the axially extending ribs 19.

Axial movement of the connecting elements 23 is constrained by the axially and circumferentially extending ribs 19, 21 on the one hand, and by the recesses 25 formed in the circumferential flange 17 on the other hand. The resilience of the connecting elements 23 does, however allow for their deformation by the application of side forces in the circumferential direction.

The connecting elements are maintained in their positions by the outer sleeve 11 which, of course, is not shown in FIG. 3.

Figure 6:
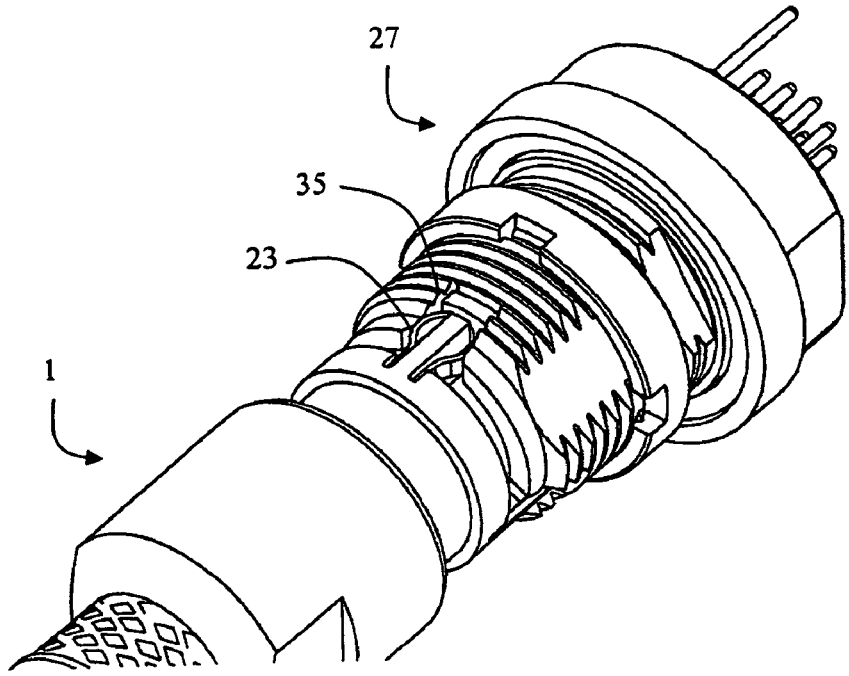
FIG. 6 is a perspective view of the connectors shown in FIGS. 1 and 6 mechanically and electrically coupled together.

Use of the connector 1 will now be explained with reference to the mating connector 27 shown in FIGS. 5 and 6. The mating connector 27 is arranged for mounting in the wall of an enclosure (not shown) and at one end is terminated in pins 29 for connection to the tracks of a printed circuit board (not shown).

The other end of the mating connector 27 is adapted for mechanical and electrical connection to the connector 1 shown in FIGS. 1 to 4. For this, the mating connector 27 comprises a conductive sleeve 31 for electrically shielding the connector 27 and a plurality of elongate inner terminals 33 arranged within the sleeve 31. Suitable arrangements for the inner terminals 33 are conventional and are not therefore explained herein in detail.

The sleeve 31 of the mating connector 27 is provided with cut outs 35 arranged around its circumference to correspond to the positions of the circumferentially extending ribs 21 of the connector 1. An outer surface of the sleeve 31 of the mating connector is provided with a screw thread corresponding to the screw thread formed in the inner surface of the outer sleeve 11 of the connector 1.

In use, the sleeve 31 of the mating connector 27 is received between the inner and outer sleeves 5, 11 of the connector 1. The screw thread formed in the inner surface of the outer sleeve 11 of the connector 1 is then engaged with and tightened onto the screw thread formed in the outer surface of the sleeve 31 of the mating connector 27.

As part of this process, the circumferentially extending ribs 21 formed on the inner sleeve 5 of the connector 1 are received into the corresponding cut outs 35 formed in the sleeve 31 of the mating connector 27, to thereby circumferentially locate the connectors 1, 27 with respect to each other.

As the circumferentially extending ribs 21 are received into the cut outs 35, the connecting elements 23 engage with the sides of the cut outs 35. This engagement is caused by the interference fit between the connecting elements 23 and the cut outs 35. Consequently, once the connectors 1, 27 have been mechanically coupled, the connecting elements resiliently bear against both the axially extending ribs 19 of the inner sleeve 5 of the connector 1 and the cut out walls of the sleeve 31 of the mating connector 27. In this way, a reliable electrical connection between the shielding sleeves of the connectors is formed.

The connector 1 therefore provides for reliable connection of the electrical shielding in shielded connectors, which is achieved within the space usually occupied by the keying arrangement of conventional connectors. Consequently, it is possible to reduce the axial dimension of the connector 1.

A specific example of the invention has been described above. However, those skilled in the art will recognize that various changes and additions may be made to the example without departing from the scope of the invention, which is defined by the claims.

For example, a sleeve of the connector described above has protrusions whose sides are provided with resilient connecting elements. The protrusions mate with cut outs in a sleeve of a mating connector. However, in other embodiments of the invention, the sleeve may be provided with recesses or cut outs whose sides have resilient connecting elements. In this case, the recesses or cut outs mate with protrusions in the sleeve of a mating connector.

A variety of suitable materials for the components of the connector will be apparent. In general, low resistance metals such as copper are preferred for the conductive parts and high resistance materials such as plastics or ceramics materials are preferred for the dielectric parts.

The various dimensions, proportions and scale of components may be altered, as long as an interference fit is maintained between the connecting elements of the connector and the cut outs or recesses in the sleeve of the mating connector.

Connectors according to the invention may be for terminating cables or may have terminals arranged for direct connection to other structures, such as printed circuit boards.

Connectors according to the invention may have any practical number of inner terminals, with some embodiments having a single inner terminal.

In some embodiments, the screw threads for mechanically locking the connectors may be substituted for other locking mechanisms. In some embodiments the locking mechanism, including the entire outer sleeve of the connector, may be omitted.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector comprising a first conductive sleeve for providing an electrical grounding connection, the conductive sleeve having at least one discrete radial protrusion provided around the circumference of the sleeve, wherein said protrusion has at least one side surface, and including a resilient conductive electrical connecting means arranged such that, when the protrusion is mated with a corresponding recess in a sleeve of a mating connector, the conductive electrical connecting means is deformed and thereby bears on the sleeves of both connectors;

said protrusion comprises an axially extending rib, and the resilient conductive electrical connecting means comprises an elongate metallic element extending around a first end of the axial rib, the metallic element having opposite sides that are curved and arranged for bearing on the side surfaces of the axial rib.

2. An electrical connector according to claim 1, wherein the first sleeve defines a flange at a second end of the axial rib for restricting axial and rotational movement of the metallic element.

3. An electrical connector according to claim 1, wherein said metallic element has ends, said axial rib has an end, and said first conductive sleeve defines at least one recess at said end of the first conductive sleeve for receiving the ends of the metallic element.

4. An electrical connector according to claim 1, wherein the metallic element is resiliently deformable towards the side surfaces of the axial rib.

5. An electrical connector according to claim 4, wherein the metallic element is arranged for an interference fit with the recess in the sleeve of the mating connector.

6. An electrical connector according to claim 1, wherein the first sleeve further has a second discrete radial protrusion arranged axially in front of the axial rib for circumferentially locating the connectors with respect to each other, and wherein the circumferential dimension of the second protrusion is greater than the corresponding dimension of the axial rib and less than the corresponding dimension of the metallic element.

7. An electrical connector assembly (10) comprising first and second connectors (1, 27) that are mateable by each moving forward (F1, F2) towards the other along a mating axis (12), said first connector having a conductive first sleeve (5) and said second connector having a conductive second sleeve (31) with one of said sleeves fitting into the other one, and said first connector has at least one resilient contact member (23) that engages said second sleeve when said connectors mate, wherein:

said second sleeve has at least one radial sleeve slot (35) that extends parallel to said axis and that has circumferentially opposite slot walls (36, 37), and said resilient contact element (23) has an engaging part (28) that fits into said slot when the connectors mate, with said engaging part having opposite contacting sides (26, 27) that engage said slot sides (36, 37) when said connectors mate;

said first sleeve has a connector locating rib (21) lying forward of said contact element engaging part (28) and locating said opposite slot walls in line with said opposite engaging sides of said resilient contact element.

8. An electrical connector assembly (10) comprising first and second connectors (1, 27) that are mateable by each moving forward (F1, F2) towards the other along a mating axis (12), said first connector having a conductive first sleeve (5) and said second connector having a conductive second sleeve (31) with one of said sleeves fitting into the other one, and said first connector has at least one resilient contact member (23) that engages said second sleeve when said connectors mate, wherein:

said second sleeve has at least one radial sleeve slot (35) that extends parallel to said axis and that has circumferentially opposite slot walls (36, 37), and said resilient contact element (23) has an engaging part (28) that fits into said slot when the connectors mate, with said engaging part having opposite contacting sides (26, 27) that engage said slot sides (36, 37) when said connectors mate;

said contact member comprises an elongated element with a middle bent into a loop of more than 180°, and with opposite ends forming legs (29) extending parallel to each other;

said first sleeve has a pair of parallel axially-extending grooves (25) and said legs of said resilient contact member lie in said grooves with said engaging part projecting forward of said grooves.

9. The assembly described in claim 8, wherein:

said first sleeve has an axially-extending rib (19) that lies between said opposite engaging sides of said contact member and that has a rib front end that lies within said bent middle of said contact member.

10. An electrical connector comprising:

a conductive first sleeve for providing an electrical grounding connection, the first sleeve having an axis and having at least one rib projecting outward from an outer surface of the first sleeve, the at least one rib having opposite rib sides;

a resilient electrically conductive connecting element that is mounted on the first sleeve and that has opposite element sides that lie from the opposite rib sides, so when the first sleeve is mated with a corresponding recess in a second sleeve of a mating connector, the opposite element sides are deflected circumferentially toward the opposite rib sides; and an outer sleeve lying around the first sleeve, wherein the resilient electrically conductive connecting element is captively arranged between the first sleeve and the outer sleeve.

* * * * *